US007690655B2

(12) United States Patent
Moody

(10) Patent No.: US 7,690,655 B2
(45) Date of Patent: Apr. 6, 2010

(54) HOLD 'EM POKER WITH MULTIPLE OPPONENTS HANDS

(76) Inventor: Ernest W Moody, 2116 Redbird Dr., Las Vegas, NV (US) 89134

( * ) Notice: Subject to any disclaimer, the term of this patent is extended or adjusted under 35 U.S.C. 154(b) by 72 days.

(21) Appl. No.: 11/844,611

(22) Filed: Aug. 24, 2007

(65) Prior Publication Data

US 2009/0051113 A1 Feb. 26, 2009

(51) Int. Cl.
*A63F 1/00* (2006.01)
*G07F 17/34* (2006.01)

(52) U.S. Cl. ..... 273/292; 463/13

(58) Field of Classification Search ..... 273/292, 273/274, 309, 138.2; 463/13, 12
See application file for complete search history.

(56) References Cited

U.S. PATENT DOCUMENTS 5,046,736 A * 9/1991 Bridgeman et al. ..... 463/13
5,382,025 A * 1/1995 Sklansky et al. ..... 273/292
6,332,614 B1 * 12/2001 Hesse ..... 273/292
6,511,068 B1 * 1/2003 Sklansky et al. ..... 273/237
6,695,695 B2 * 2/2004 Angel ..... 463/13

* cited by examiner

*Primary Examiner*—Benjamin H Layno
(74) *Attorney, Agent, or Firm*—John Edward Roethel

(57) ABSTRACT

The player is dealt two hole cards. Each opponent is dealt two hole cards. The player has the option to raise or check. If the player raises, all opponents must raise. If the player checks, all opponents must check. Then three community cards are dealt. If the player raises or checks, all opponents must raise or check likewise. Then the final two community cards are dealt. If the player raises or checks, all opponents must raise or check likewise. All of the opponents hole cards are exposed. Whoever has the highest five card poker hand by category wins the pot. If two or more of the opponents and the player have the same highest five card poker hand by category, the hand is a tie and the pot carries over to the next round of play.

10 Claims, 7 Drawing Sheets

HOLD 'EM POKER WITH MULTIPLE OPPONENTS HANDS

This invention relates primarily to poker games, and more particularly to poker games played against multiple opponents. The game of the present invention is based on poker games that use a group of community cards that are shared by each player.

BACKGROUND OF THE INVENTION

Many forms of poker use multiple players. Quite often in these multiple player games, the object for the player is to have a higher ranking poker hand than all of the other players. In order to participate in the game, the players make wagers which are collected in a common pot. Usually, the first wager by each player is called the Ante wager. During the play of the poker game, various betting rounds occur at which each player may make additional wagers. Players may also fold at any point in the poker game upon which the player is withdrawing from further participation in that round of the game. Poker games that have more than one betting round can result in much larger common pots.

At the end of the round of the game, the player with the best poker hand wins the pot. These multiple player poker games can be played as either draw poker games or stud poker games.

Poker can be played using community cards. A community card is a card that is shared among all of the players in the game. Typically, community cards are displayed face up in the center of the table so that all players can see the community cards.

A very popular form of poker that uses one or more community cards is the Hold 'Em format. A player initially receives one or more Hole cards which are cards unique to that player. Then a plurality of community cards are displayed during which betting rounds occur. The player with the best five card poker hand at the end of the game wins the common pot.

In Texas Hold 'Em Poker, each player receives two Hole cards and a round of betting occurs. Then three community cards (the Flop) are displayed and another round of betting occurs. Then a fourth community card (the Turn or Fourth Street) is displayed and another round of betting occurs. Finally, a fifth community card (the River or Fifth Street) is displayed and another round of betting occurs. The player with the best poker hand out of the seven cards (his two Hole cards and the five community cards) wins the common pot.

Because of the current popularity of Hold 'Em poker games, there have been attempts to adapt Hold 'Em poker to a video poker machine format.

SUMMARY OF THE INVENTION

The game of the present invention involves playing a Hold 'Em poker type game in a contest between a player and multiple opponents. The player makes a wager to be eligible to play the game and wagers are made by the opponents. All of the wagers are collected in a common pot. The player is dealt two hole cards. Each opponent is dealt two hole cards. The player has the option to raise or check. If the player raises, all opponents must raise. If the player checks, all opponents must check.

Then three community cards are dealt. The player has the option to raise or check. If the player raises, all opponents must raise. If the player checks, all opponents must check.

Then the final two community cards are dealt. The player has the option to raise or check. If the player raises, all opponents must raise. If the player checks, all opponents must check.

All of the opponents hole cards are exposed. Whoever has the highest five card poker hand by category wins the pot. If two or more of the opponents and the player have the same highest five card poker hand by category, the hand is a tie and the pot carries over to the next round of play.

The player may also make a side bet based on the poker hand ranking of just the player's best five card hand.

DETAILED DESCRIPTION OF THE PREFERRED EMBODIMENTS

Figure 1:
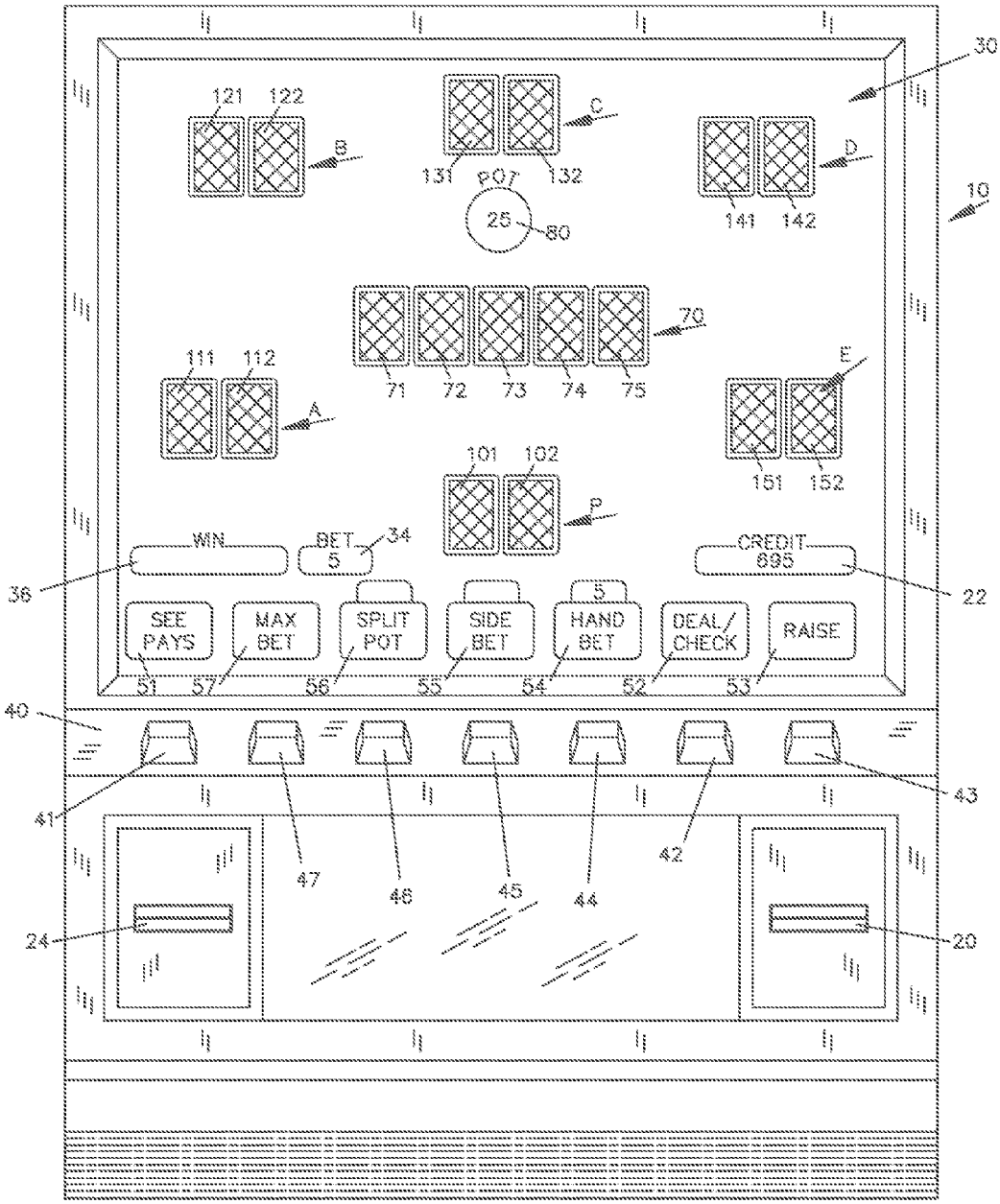
FIG. 1 shows a representative electronic video gaming machine of the present invention including a typical screen display used in the method of play of version #1 of the present invention prior to the initial deal of the cards.

FIG. 1 shows generally at 10 a typical electronic video gaming machine that is configured to practice the method of the present invention. The electronic video gaming machine 10 includes a slot 20 which leads to a conventional bill acceptor mounted on the interior of the gaming machine and into which the player can insert paper currency and gaming tickets. The use of paper currency or gaming tickets is the mechanism by which the player adds monetary value to the gaming machine so that the player can make wagers during the play of the game. If desired, the gaming machine manufacture can provide a conventional coin head (not shown) by which the player may use coins or gaming tokens to add monetary value to the gaming machine.

As is also conventional in electronic video gaming machines, a credit meter display 22 is provided to show the amount of credits that the player has accrued on the gaming machine 10—either by inserting paper currency, gaming tickets or from winning plays by the player. Whenever the player makes a wager, the amount of the wager is decremented from the credit meter display 22. Whenever the player achieves a winning play during the play of the game, the amount of the winning play is incremented on the credit meter display 22.

A conventional gaming ticket printer is provided on the interior of the gaming machine and gaming tickets are presented to the player through the cash out slot 24 when the player wishes to collect any credits the player has accrued on the credit meter 22. It is also possible to provide a payout hopper if the gaming manufacturer or gaming establishment wishes to dispense coins or gaming tokens when the player cashes out.

The gaming machine 10 also includes a video screen display 30 of any suitable type upon which representations of playing cards are displayed. In a preferred embodiment of the present invention, one or more hands can be displayed on the video screen display 30 at the same time. The video screen display 30 also contains a location at which the amount wagered on each hand is shown, for example, "Bet" 34. Also shown is a location at which the amount won by the player on any particular round of play is shown, for example, "Win" 36.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "CASH OUT" button 41 is provided to allow the player to collect any credits the player has accrued on the credit meter 22. A "DEAL/CHECK" button 42 and an equivalent "DEAL/CHECK" screen 52 are provided to allow the player to effect the deal or check step of the method of play as appropriate during the play of a round of the game.

A "SEE PAYS" screen location 51 is provided to allow the player to view the pay table being used in conjunction with the method of play. A "HELP" screen location (not shown), as is conventional, may also be provided at which the player may view information about the play of the game.

A "BET MAX" button 47 and an equivalent "BET MAX" screen location 57 are provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location (not shown) can be provided on the video screen 30 and an equivalent BET ONE button (not shown) can be provided on the button panel 40 to allow the player to wager in increments of one credit.

A "SIDE BET" button 45 and an equivalent "SIDE BET" screen location 55 are provided to allow the player to place a side bet during the play of the side bet version of the present invention. A "SPLIT POT" button 46 and an equivalent "SPLIT POT" screen location 56 are provided to allow the player to activate the split pot feature of the method of play as appropriate as will be explained further below.

The method of play of the various versions of the present invention will now be described. After the player has inserted an appropriate amount of paper currency or gaming tickets to add a sufficient amount of credits on the credit display meter 22, the player makes his initial wager. The player may press the HAND BET button 44 or the HAND BET location 54 one or more times to bet in single increments up to the maximum number of credits that are permitted, for example, five credits could be the maximum amount wagered. The initial wager made by the player is required for the player to be eligible to win payouts having a monetary value during the play of the game.

Alternatively, the method of play may be effected without a wager so that the game can be played as merely an amusement game without receiving payouts having monetary value. The score can be accumulated using points representing non-monetary wagers or the score can be kept in any other suitable manner.

Version #1

As shown in FIG. 1, Version #1 of the present invention has the player P playing against five opponents A, B, C, D and E. Assuming the player has made an initial wager of five credits, each opponent (except one opponent) makes a matching initial wager of five credits resulting in an initial common POT 80 amount of 25 credits. In order to make the method of play of the present invention suitable for a gaming establishment, a house edge must be built into the method of play. By using five opponents who make a combined wager of four times the player's wager, the house edge is built into the method of play. In effect, one opponent is playing for free. In this manner of creating the house edge, the wager made by the player must be higher than the average of the opponent's wagers. Thus any number of opponents can be used against a single player. All wagers made during the play of the opponents game are collected into the common pot 80.

Alternatively, if a different manner of creating a house edge is desired to be used, then each opponent player can make the same wager as the player. For example, a portion of the wagers, such as a percentage or flat fee amount, can be raked from the pot 80 during the play of each hand and allocated to create the house edge and provide revenue to the house.

After the player has made his initial wager, two hole cards 101 and 102 are displayed to the player face up. The hole cards for each opponent A, B, C, D and E are dealt but remain face down. After receiving his hole cards 101 and 102, the player may check or raise. If the player checks, all of the opponents must check. If the player raises, all of the opponents must raise. As explained above, only four of the five opponents will actually contribute money to the pot 80 to provide the house edge. Alternatively, as explained above, if a different manner of providing the house edge is used, then all five opponents would raise when the player raises.

Figure 2:
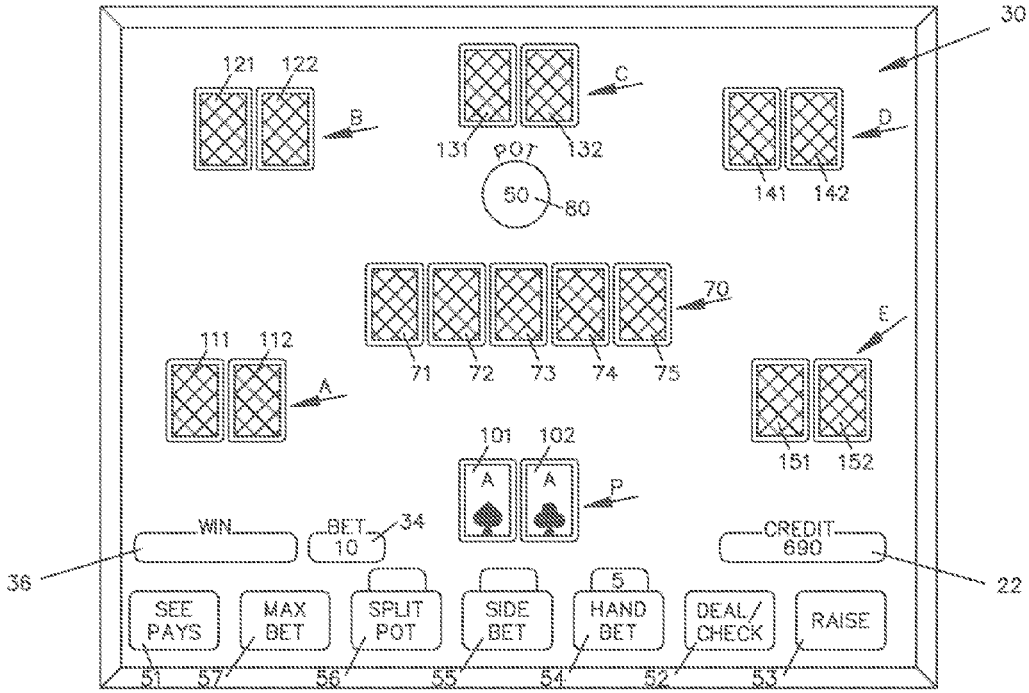
FIG. 2 shows a representative screen display used in the method of play of version #1 of the present invention after the initial deal of the hole cards to the player.

As shown in the example in FIG. 2, the player has received an Ace of Spades 101 and an Ace of Clubs 102 as the player's hole cards. In this example, the player has raised after receiving his hole cards and the amount wagered by the player is now shown as 10 at the BET location 34. Four of the opponents match the players wager and the pot 80 now shows 50 credits.

The next step is the first three community cards 71, 72 and 73 are displayed face up at the community card location 70 on the screen display 30. Again the player may now check or raise. If the player checks, all of the opponents must check. If the player raises, all of the opponents must raise. As explained above, only four of the five opponents will actually contribute money to the pot 80 to provide the house edge. Alternatively, as explained above, if a different manner of providing the house edge is used, then all five opponents would raise when the player raises.

Figure 3:
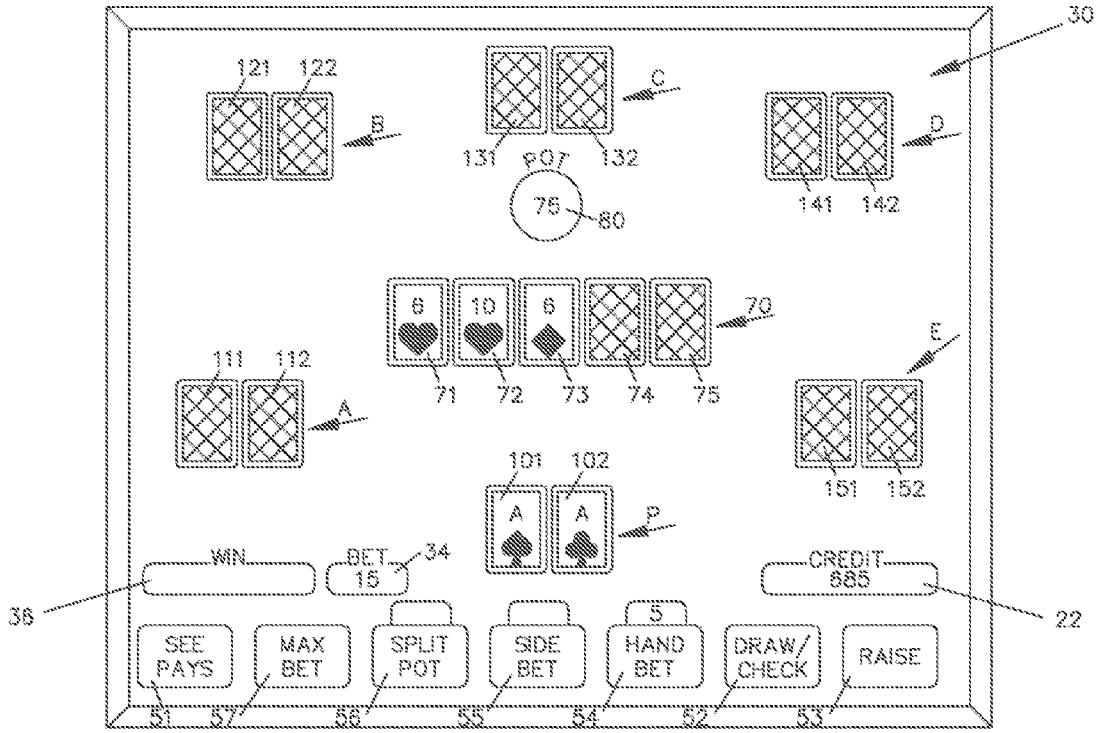
FIG. 3 shows a representative screen display used in the method of play of version #1 of the present invention after the deal of the first three community cards.

As shown in FIG. 3, the first three community cards are the Six of Hearts 71, the Ten of Hearts 72 and the Six of Diamonds 73. Again the player may now check or raise. If the player checks, all of the opponents must check. If the player raises, all of the opponents must raise. As explained above, only four of the five opponents will actually contribute money to the pot 80 to provide the house edge. Alternatively, as explained above, if a different manner of providing the house edge is used, then all five opponents would raise when the player raises.

In this example as shown in FIG. 3, the player has raised after seeing the first three community cards and the amount wagered by the player is now shown as 15 at the BET location 34. Four of the opponents match the players wager and the pot 80 now shows 75 credits.

Figure 4:
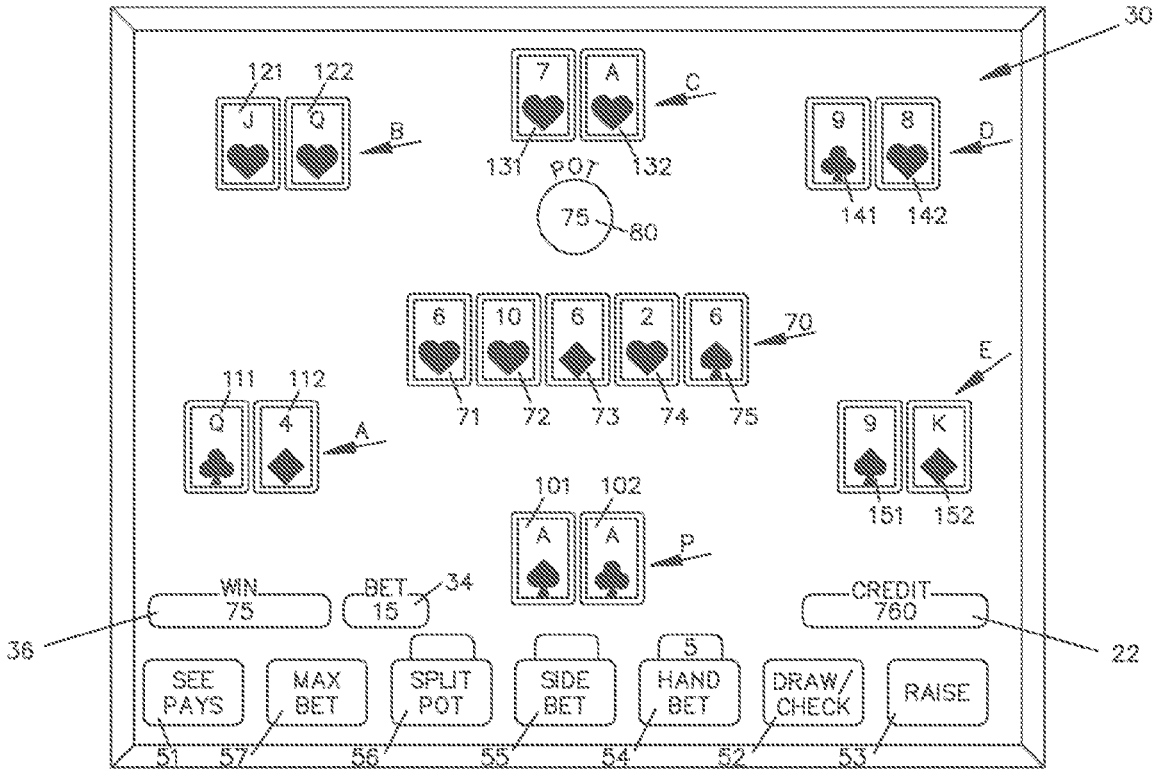
FIG. 4 shows a representative screen display used in the method of play of version #1 of the present invention after the deal of the final two community cards.

The next step is the final two community cards 74 and 75 are displayed face up at the community card location 70 on the screen display 30. As shown in FIG. 4, the final two community cards are the Two of Hearts 74 and the Six of Spades 75. This results in the player having a final hand of a Full House using the best five card hand that can be made from the player's two hole cards 101 and 102 and the five community cards and 71, 72, 73, 74 and 75.

Each of the opponents two hole cards are revealed and the poker hand ranking of each of the opponents hands are determined. In the example shown in FIG. 4, opponent A has as his hole cards the Queen of Clubs 111 and the Four of Diamonds 112. Opponent A's best five card poker hand is a Three-of-a-Kind. Opponent B has as his hole cards the Jack of Hearts 121 and the Queen of Hearts 122 and his best five card poker hand is a Flush. Opponent C has as his hole cards the Seven of Hearts 131 and the Ace of Hearts 132 and his best five card poker hand is a Flush. Opponent D has as his hole cards the Nine of Clubs 141 and the Eight of Spades 142 and his best five card poker hand is Three-of-a-Kind. Opponent E has as his hole cards the Nine of Spades 151 and the King of Diamonds 152 and his best five card poker hand is Three-of-a-Kind.

Winning, losing and tying hands are determined by poker hand category so that all final hands of the same poker hand category are considered as equal. Poker hand categories are based on the poker format being used. For example, if Jacks or Better Draw Poker is the poker format being used, the poker categories shown highest to lowest are:

Royal Flush
Straight Flush
Four-of-a-Kind
Full House
Flush
Straight
Three-of-a-Kind
Two Pair
Pair Jacks or Better
All other card combinations With reference to the example shown in FIG. 4, the player P has a final poker hand category of a Full House. None of the opponents has a final poker hand category of a Full House or better, so the player wins this round of the game and collects the seventy-five credits shown in the pot 80.

Figure 5:
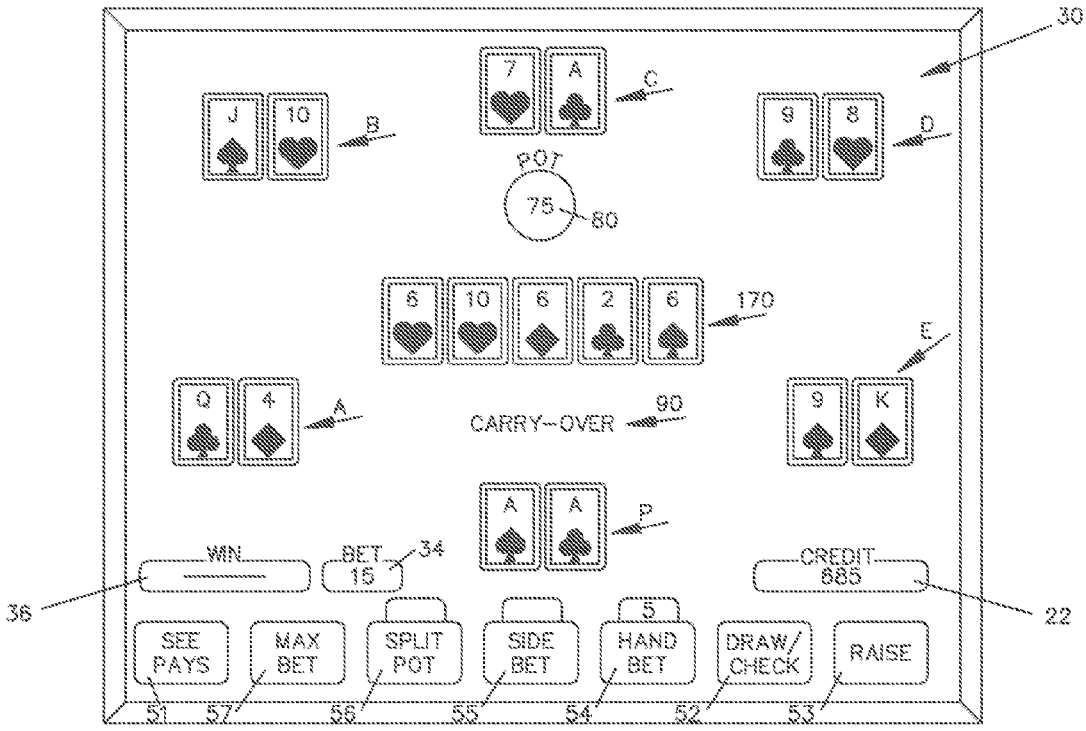
FIG. 5 shows a representative screen display used in the method of play of version #1 of the present invention after the deal of the final two community cards when a carryover hand occurs.

A different outcome is shown in the example shown in FIG. 5. Using the community cards 170 that were displayed on this deal, the player P has a final poker hand category of a Full House and the opponent B also has a final poker hand category of a Full House. This is considered a tie hand, so no one wins the pot and the credits in the pot 80 carryover to the next round of play. The player and all of the opponents play in the next round of play since if two hands tie, it is considered as if all hands tie. In this situation, an alert 90 may be displayed on the video screen 30 indicating a CARRYOVER has occurred.

Whenever a carryover occurs, the player may elect to end the carryover of the credits in the pot 80 by activating the SPLIT pot feature of the present invention. The player does this by pressing the SPLIT location 56 on the screen display or by pressing the SPLIT button 46 on the button panel 40. This causes the credits in the pot 80 to be split among the player and the opponents who are making wagers. In this situation, an alert 92 may be displayed on the video screen 30 indicating a SPLIT has occurred.

Figure 6:
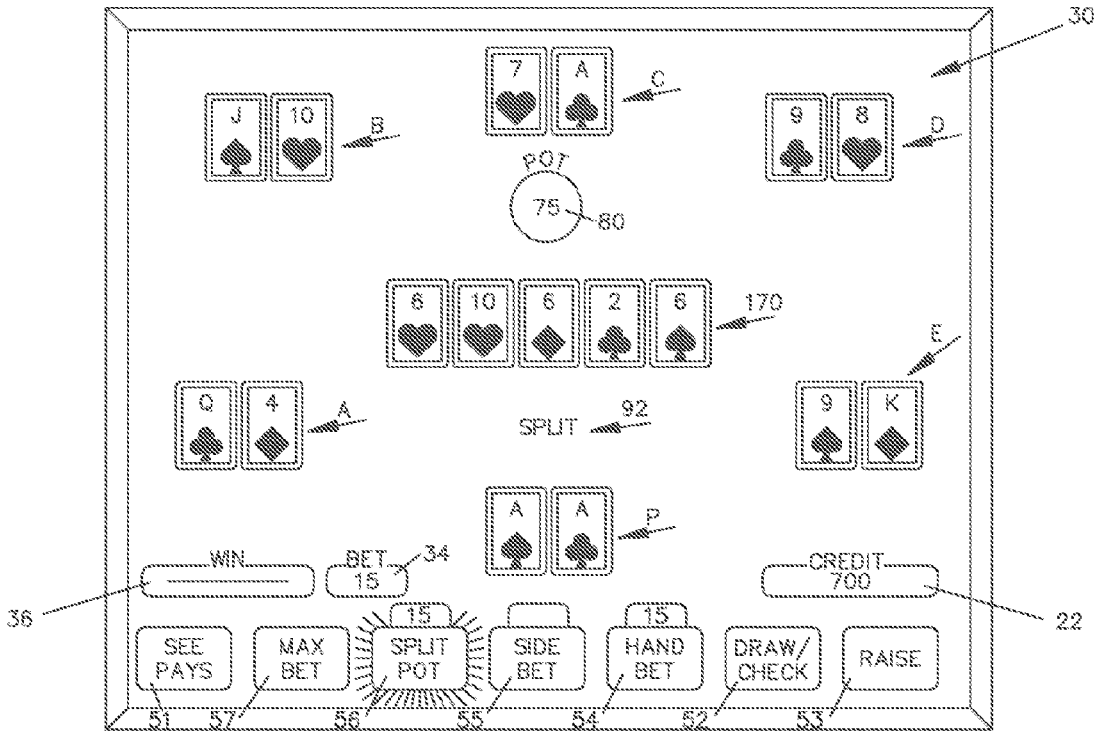
FIG. 6 shows a representative screen display used in the method of play of version #1 of the present invention after the deal of the final two community cards and the player elects to effect the SPLIT hand feature.

In this example, the seventy-five credits in the pot 80 are split among the player and four wagering opponents so that the player receives fifteen credits as shown in FIG. 6. The SPLIT feature may be activated by the player at the end of any round of play which has a carryover amount in the pot 80.

Figure 7:
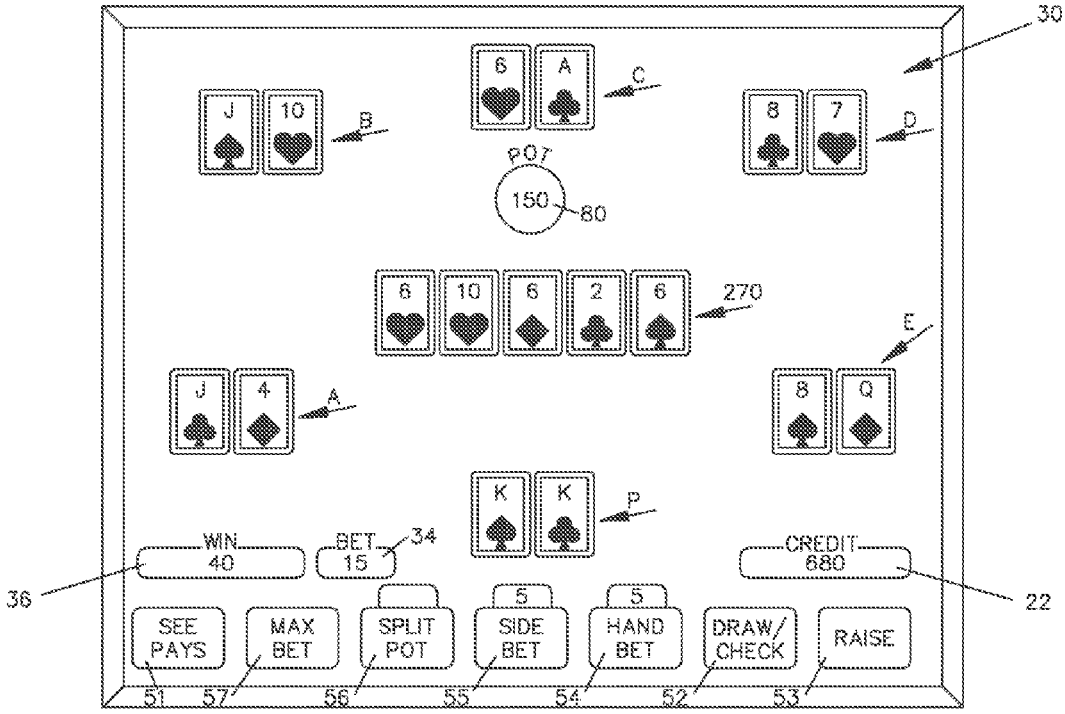
FIG. 7 shows a representative screen display used in the method of play of version #1 of the present invention after the deal of the final two community cards of a second round of play following a carryover hand.

FIG. 7 shows an example of a second round of play after the first round of play has ended in a carryover. As the second round was played out, the player had two Kings as his hold cards and the player raised at each of the two opportunities during the display of the community cards 270. Since the opponents were required to make matching wagers whenever the player wagered, the pot 80 reached a total of 150 credits.

When the opponents cards were revealed, opponent C had a final poker hand category of a Four-of-a-Kind. No other opponent or the player had a final poker hand category equal to or higher than the Four-of-a-Kind of opponent C. Since an opponent beat the player, the player loses this round of play and the amount in the pot 80 resets to zero for the next round of play. Thus the wagers made during the player of this round revert to the house.

Version #2

Version #2 of the present invention adds a side bet by the player to the method of play set out in Version #1.

As shown in FIG. 7, at the beginning of a round of play, the player may make a side bet by pressing the SIDE BET location 55 on the screen display 30 or by pressing the SIDE BET button 45 on the button panel 40. The side bet may be any amount allowed by the gaming establishment, but would typically be the same amount wagered by the player as his HAND BET, such as five credits as shown in FIG. 7 at SIDE BET location 55.

The side bet is determined solely on the best five card poker category hand that the player may achieve from his two hole cards and the five community cards. In the example as shown in FIG. 7, the player's best five card poker category hand is a Full House. The amount won by the player for a winning poker category hand is based on the amount wagered by the player as a side bet and the poker category hand achieved by the player and is shown in a pay table. For example, using the pay table of Table 1, the player would win forty credits for a Full House based on a five credit SIDE BET wager. The player is not required to beat or tie any of the opponents' hands to win the side bet. The outcome of the side bet is based solely on the player's hand.

Any suitable pay table may be used and would be associated with the poker format being used by the player. For example, a classic poker hand format is Jacks or Better Draw Poker. A suitable pay table for Jacks or Better Draw Poker is shown in Table 1:

TABLE 1

| JACKS OR BETTER DRAW POKER | NUMBER OF COINS WAGERED | | | | |
|---|---|---|---|---|---|
| POKER HAND CATEGORY | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| PAIR JACKS OR BETTER | 1 | 2 | 3 | 4 | 5 |

Other poker formats and pay tables may be used for the opponent poker game and the side bet wager. The method of play typically uses a standard deck of fifty-two playing cards, but may include one or more jokers if desired. Wild cards may also be used.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game between a player and at least one opponent comprising:

a) establishing a group of poker hand categories ranking from highest to lowest, providing a deck of playing cards;

b) the player making a wager and at least one opponent making a wager; the amount of the wager made by the player being higher than the average of the opponent's wagers;

c) displaying two holes cards face up to the player;

d) displaying two holes cards face down to each opponent;

e) the player either checking or making a raising wager, with each opponent also checking if the player checks and raising if the player raises; the amount of the wager made by the player being higher than the average of the opponent's wagers;

f) displaying a first, second and third community card face up;

g) the player either checking or making a raising wager, with each opponent also checking if the player checks and raising if the player raises; the amount of the wager made by the player being higher than the average of the opponent's wagers;

h) displaying a fourth and fifth community card face up;

i) the player either checking or making a raising wager, with each opponent also checking if the player checks and raising if the player raises; the amount of the wager made by the player being higher than the average of the opponent's wagers;

j) displaying face up the hole cards of each opponent;

k) collecting all wagers into a common pot and determining the poker hand ranking of the player's final five card hand using the player's two hole cards and the five community cards;

l) determining the poker hand ranking of each of the opponent's final five card hand using each opponent's two hole cards and the five community cards;

m) declaring as the winning hand the final five card hand that has the highest poker hand category ranking from among the player's final five card hand and each of the opponent's final five card hand; and n) awarding the common pot to the winning hand.

2. The method of claim 1 in which the poker hand categories ranking from highest to lowest are Royal Flush, Straight Flush, Four-of-a-Kind, Full House, Flush, Straight, Three-of-a-Kind, Two Pair, Pair of Jacks or Better and all other card combinations.

3. The method of claim 1 in which if two or more of the player and the opponents tie with the highest hand, then the common pot carries over to a next round of play.

4. The method of claim 3 in which the player may effect a split of any common pot that has been carried over to the next round of play.

5. The method of claim 1 in which the player may make a side bet wager based on solely on the poker hand ranking of the player's final hand.

6. A method of playing a card game between a player and five opponents comprising:

a) establishing a group of poker hand categories ranking from highest to lowest, providing a deck of playing cards;

b) the player making a wager and four of the opponents making a wager in the same amount as the wager by the player, the fifth opponent making a wager in an amount lower that the wager by the player;

c) displaying two holes cards face up to the player;

d) displaying two holes cards face down to each opponent;

e) the player either checking or making a raising wager, with four of the opponents also checking if the player checks and raising if the player raises;

f) displaying a first, second and third community card face up;

g) the player either checking or making a raising wager, with four of the opponents also checking if the player checks and raising if the player raises;

h) displaying a fourth and fifth community card face up;

i) the player either checking or making a raising wager, with four of the opponents also checking if the player checks and raising if the player raises;

j) displaying face up the hole cards of each opponent;

k) collecting all wagers into a common pot and determining the poker hand ranking of the player's final five card hand using the player's two hole cards and the five community cards;

l) determining the poker hand ranking of each of the five opponents'final five card hand using each opponent's two hole cards and the five community cards;

m) declaring as the winning hand the final five card hand that has the highest poker hand category ranking from among the player's final five card hand and each of the opponents' final five card hand; and n) awarding the common pot to the winning hand.

7. The method of claim 6 in which the poker hand categories ranking from highest to lowest are Royal Flush, Straight Flush, Four-of-a-Kind, Full House, Flush, Straight, Three-of-a-Kind, Two Pair, Pair of Jacks or Better and all other card combinations.

8. The method of claim 6 in which if two or more of the player and the opponents tie with the highest hand, then the common pot carries over to a next round of play.

9. The method of claim 8 in which the player may effect a split of any common pot that has been carried over to the next round of play.

10. The method of claim 6 in which the player may make a side bet wager based on solely on the poker hand ranking of the player's final hand.

* * * * *